US007712647B2

(12) United States Patent
Tanji

(10) Patent No.: US 7,712,647 B2
(45) Date of Patent: May 11, 2010

(54) DRIVING MACHINE

(75) Inventor: Isamu Tanji, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 245 days.

(21) Appl. No.: 12/047,932

(22) Filed: Mar. 13, 2008

(65) Prior Publication Data

US 2008/0223900 A1 Sep. 18, 2008

(30) Foreign Application Priority Data

Mar. 14, 2007 (JP) ..... P2007-064321

(51) Int. Cl.
*B25C 1/04* (2006.01)
*B25C 5/13* (2006.01)

(52) U.S. Cl. ..... 227/130; 227/138; 227/109; 227/112; 227/114; 227/129

(58) Field of Classification Search ..... 227/130, 227/138, 109, 112, 114, 129
See application file for complete search history.

(56) References Cited

U.S. PATENT DOCUMENTS 3,622,062 A * 11/1971 Goode et al. ..... 227/130
3,708,096 A * 1/1973 Burke, Jr. ..... 227/130
3,734,377 A * 5/1973 Munn ..... 227/120
3,945,551 A * 3/1976 Sato et al. ..... 227/136
3,969,988 A * 7/1976 Maurer ..... 92/19
4,194,665 A * 3/1980 Maestri ..... 227/112
4,294,391 A * 10/1981 Obergfell ..... 227/130
4,784,308 A * 11/1988 Novak et al. ..... 227/130
5,131,579 A * 7/1992 Okushima et al. ..... 227/8
5,775,201 A * 7/1998 Tanji et al. ..... 92/85 R
6,062,113 A * 5/2000 Nakano et al. ..... 81/434
7,137,186 B2 * 11/2006 Wojcicki et al. ..... 29/592
2006/0043143 A1 * 3/2006 Kolodziej et al. ..... 227/130

FOREIGN PATENT DOCUMENTS

JP 2510176 6/1996

* cited by examiner

*Primary Examiner*—Brian D Nash
(74) *Attorney, Agent, or Firm*—McDermott Will & Emery LLP

(57) ABSTRACT

A driving machine
includes a cylinder, a piston fitted into the cylinder in a reciprocatingly movable manner, a driver connected to the piston, a bumper provided in the bottom portion of the cylinder, a housing, a return air chamber, a fastening member feed piston movable backward or forward by supplying compressed air within the return air chamber from an air chamber passage hole 9 through air passages and to a fastening member feed cylinder or discharging such compressed air from the fastening member feed cylinder, a return spring for energizing the fastening member feed piston, and a feed pawl mounted on the leading end of the fastening member feed piston. In the driving machine, between the return air chamber and the fastening member feed cylinder, a filter portion is provided having a projection shape and small holes.

20 Claims, 7 Drawing Sheets

DRIVING MACHINE

BACKGROUND OF THE INVENTION

1. Technical Field

The present invention relates to a driving machine for driving a fastening member such as a nail using compressed air as a power source.

2. Background Art

Description will be given below of an example of a conventional driving machine with reference to FIGS. 6 and 7.

FIG. 6 is a broken section view of the main portions of a conventional driving machine, and FIG. 7 is an enlarged section view of the main portions shown in FIG. 6. In the illustrated driving machine, compressed air, which is supplied from a compressor (not shown), is accumulated through an air hose (not shown) into a pressure storage chamber 2 formed in a driving machine main body 7. Within the driving machine main body 7, there is provided a tubular-shaped cylinder 5; and, into the cylinder 5, there is fitted a piston 4 which can be slid in a reciprocating manner.

On the lower portion of the piston 4, there is provided a driver 22 integrally therewith. Between a magazine (not shown) and a nose portion 23, there is interposed fastening member feed means 25. Fastening members 28 such as nails stored in the magazine are fed one by one into a shooting opening 24 formed in the nose portion 23 by the fastening member feed means 25.

Here, the fastening member feed means 25 is composed of a fastening member feed cylinder 12 and a fastening member feed piston 11. The fastening member feed piston 11 is fitted into the fastening member feed cylinder 12 in such a manner that it can be slid back and forth within the fastening member feed cylinder 12. Also, on the leading end of the fastening member feed piston 11, there is mounted a feed pawl 14 in such a manner that it can be rotated. When the fastening member feed cylinder 12 is operated, the feed pawl 14 can be moved reciprocatingly together with the feed piston 11 along a feed passage 29. When the feed pawl 14 moves backward, it comes in contact with the shaft of the fastening member 28 within the feed passage 29 and is thereby rotated in such a manner as to retreat from the feed passage 29, so that it moves beyond the fastening member 28; and, when the feed pawl 14 moves forward, it advances into the feed passage 29 and is engaged with the shaft of the fastening member 28 to thereby feed the fastening member 28.

Next, when a trigger 1 is pulled, there is started a driving process in which a cylinder valve 3 sealing the upper end of the cylinder 5 is opened, and the compressed air of the pressure storage chamber pushes down the piston 4, whereby the fastening member 28 fed into the shooting opening 24 of the nose portion 23 by the fastening member feed means 25 is driven by the leading end of the driver 22. Also, after the fastening member 28 is driven, the piston 4 collides with a bumper 8, whereby the remaining surplus energy of the piston 4 is absorbed by the bumper 8. When the piston 4 passes through air holes 5*a*, a portion of the compressed air is supplied through the air holes 5*a* and a check valve 50 to a return air chamber 6. Further, a portion of the compressed air supplied to the return air chamber 6 flows from the return air chamber 6 and is stored through air passages 18 and 19 into the fastening member feed cylinder 12, which pushes down the fastening member feed piston 11 that is tightly fitted with and is slid within the fastening member feed cylinder 12, thereby causing the feed pawl 14 to move backward.

When the trigger 1 is released, the pressure of the return air chamber 6 pushes back the piston 4 and, at the top dead center of the piston 4, the compressed air of the return air chamber 6 is exhausted from a lower exhaust port 21 existing downward of the bumper 8 or from an upper exhaust port 27 through a clearance formed upwardly of the cylinder 5; and, the feed pawl 14 is returned to its original position by a return spring 13.

Also, between a main body side passage 18 communicating with the return air chamber 6 on the main body 7 side and an air passage 19 communicating with the inside of the fastening member feed cylinder 12, there is interposed a plate-shaped filter portion 17 having a plurality of small holes 20 while the connecting portions of the passages 18 and 19 are sealed by packing 16*a*; and thus, an effective sectional area equal to the conventional passage area is secured by the plurality of small holes 20 (see the patent reference 1 Japan Utility Model Application No. 2510176).

In the above-mentioned conventional driving machine, when the above-mentioned driving operation is carried out repeatedly tens of thousands times, owing to the impact fatigue, there are caused cracks on the upper surface of the bumper 8 which is used to absorb the impact of the surplus energy, thereby forming a small broken piece 30 shown in FIG. 7. This small broken piece 30, in most cases, is discharged from the lower exhaust port 21. However, in some cases, the small broken piece 30 is moved from a return chamber passage hole 9 through the air passages 18 and 19 into the fastening member feed cylinder 12, and is accumulated in the periphery of the fastening member feed piston 11, which makes it impossible for the fastening member feed piston 11 to return to its normal position. As a result of this, the feeding operation of the fastening member feed piston 11 is incomplete, that is, the normal feeding of the fastening member 28 is impossible.

Therefore, according to the patent reference 1, in a structure in which, between the air passages, there is interposed a plate-shaped filter portion for preventing the entrance of the broken piece of the bumper, in order to prevent the broken pieces of the bumper from entering the fastening member feed cylinder, they are accumulated on the air passages using the compressed air; and, the broken pieces, which have entered the air passages once, are crammed into the air passages and are thus hard to be discharged into the return air chamber, with the result that the broken pieces close the air passages respectively formed between the return air chamber and feed cylinder. This raises the following problems: that is, a sufficient amount of compressed air cannot be supplied to the fastening member feed cylinder, and the compressed air supplied to the fastening member feed cylinder cannot be exhausted, whereby the forward and backward movements of the feed piston are made incomplete and, therefore, the fastening members such as connected nails cannot be fed properly.

SUMMARY OF THE INVENTION

The present invention aims at solving the above problems and thus it is an object of the invention to provide a driving machine which, even when a bumper is broken and broken pieces are produced, can prevent the broken pieces from entering an air passage to thereby always be able to feed a fastening member properly.

In attaining the above object, according to the invention, there is provided a driving machine which uses compressed air as a power source and comprises: a cylinder; a piston fitted into the cylinder such that it can be reciprocated; a driver connected to the piston; a bumper provided on the bottom portion of the cylinder; a housing disposed so as to cover the cylinder from outside and including therein a pressure storage chamber for storing compressed air; a return air chamber formed in the outer periphery of the cylinder for storing the return compressed air that is used to move up and return the piston; an exhaust port, after the piston is returned, for discharging compressed air existing downwardly of the piston to the air; a fastening member feed piston movable backward or movable forward by supplying the compressed air of the return air chamber from the passage hole of the return air chamber through an air passage into the fastening member feed cylinder or by discharging such compressed air from the fastening member feed cylinder; a return spring for energizing the fastening member feed piston in one direction; and, a feed pawl mounted on the leading end of the fastening member feed piston, wherein, within the air passage formed between the return air chamber and the fastening member feed cylinder, there is formed a filter portion and, in the vicinity of the leading end of the projection-shaped portion of the filter portion, there is formed the passage hole.

According to the invention, in the invention as set forth in Claim 1, the passage hole opened up in the vicinity of the leading end of the projection-shaped portion of the filter portion is made of a thin-film-shaped mesh, and the passage hole is opened in the return air chamber by mounting the mesh from the outside of the housing into the return air chamber.

According to the invention as set forth in Claim 3, the invention as set forth in Claim 2, the filter portion is made of plastic, and the filter portion and the mesh are formed as an integral body.

According to the invention, even when the broken pieces of the bumper enter the return air chamber and, with the flow of the compressed air into the fastening member feed means, the broken pieces of the bumper are going to move through the main body side passage into the air passage, since the projection-shaped filter portion projecting into the return air chamber is formed in the vicinity of the main body side passage, the filter portion prevents the broken pieces from moving into the air passage, whereby the feeding operation of the fastening member can be carried out properly. And, since there can be secured a large opening area in the filter portion, in the filter portion, there can be sufficiently secured a flow-in area equal to or larger than the air passage; and, therefore, even when the bumper is slightly broken and the broken pieces thereof stick to the filter portion, the feeding operation of the fastening member can be always carried out properly.

Also, since the filter portion is structured separately from the housing, the filter portion can be taken out from the housing easily and thus the broken pieces sticking to the filter portion can be cleaned simply.

DETAILED DESCRIPTION OF THE INVENTION

Now, description will be given below of a driving machine according to an embodiment of the invention with reference to the accompanying drawings.

Figure 6:
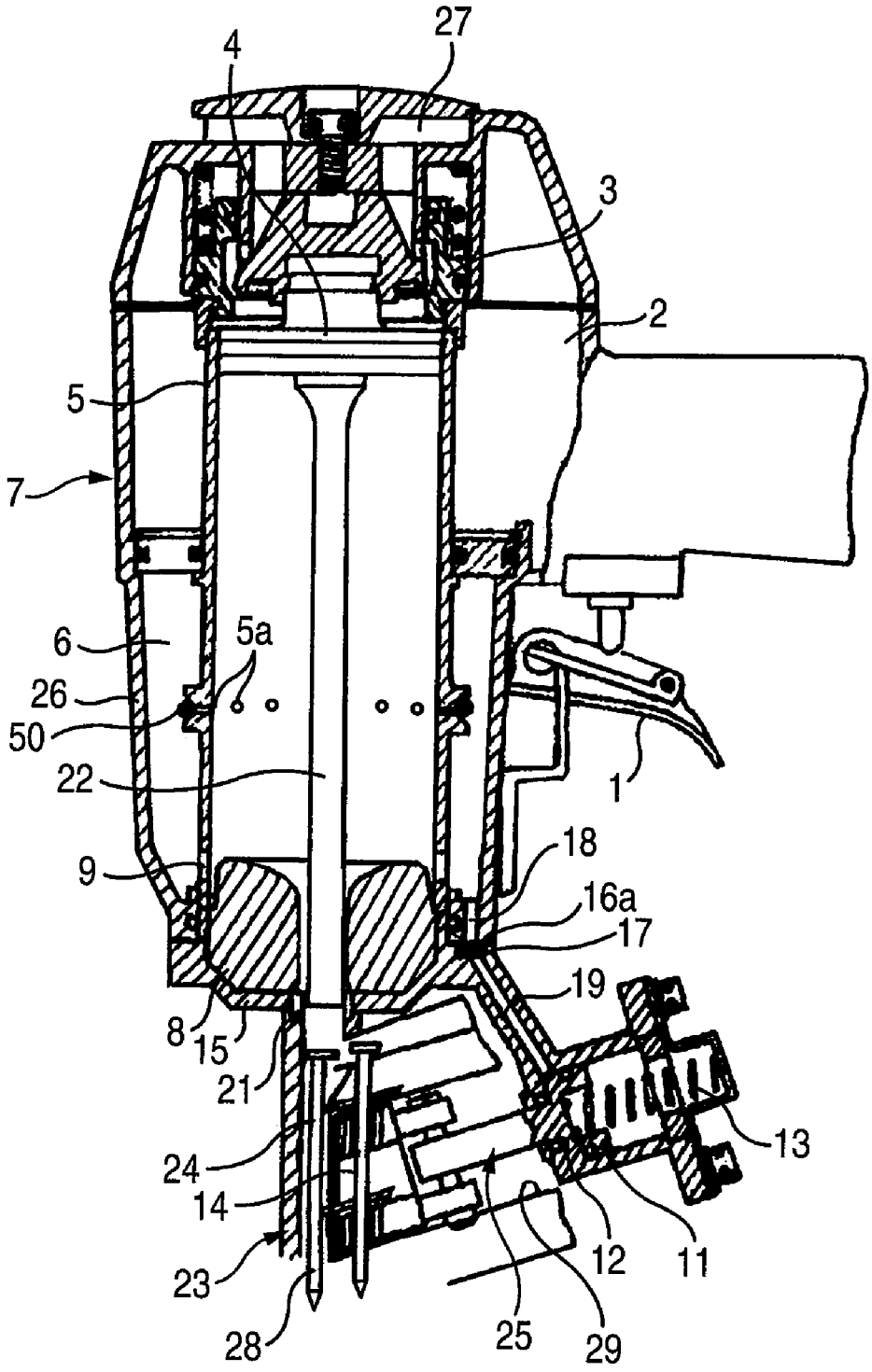
FIG. 6 is a broken section view of a filter portion of a conventional driving machine.
Figure 7:
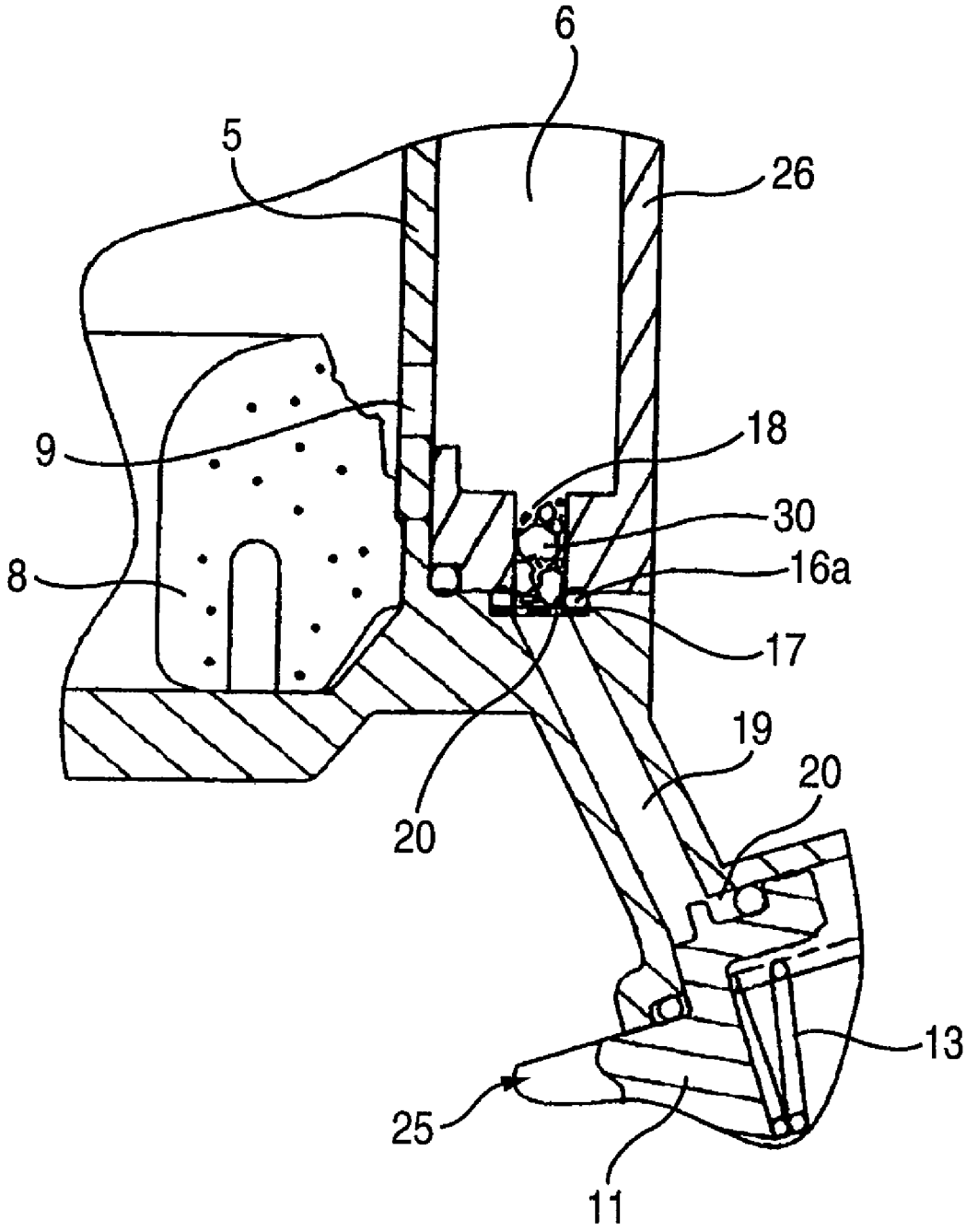
FIG. 7 is an enlarged section view of the main portions of the conventional driving machine shown in FIG. 6.

The basic structure of a driving machine according to the invention is similar to that of the conventional driving machine shown in FIGS. 6 and 7 and, therefore, description will be given below of the basic structure of the driving machine according to the invention with reference to FIGS. 6 and 7.

In the driving machine according to the invention, compressed air from a compressor (not shown) is accumulated through an air hose (not shown) into the pressure storage chamber 2 formed within the driving machine main body 7. Within the driving machine main body 7, there is disposed a tubular-shaped cylinder 5; and, into the cylinder 5, there is fitted a piston 4 in such a state that it can be slid in a reciprocating manner. And, on the lower portion of the piston 4, there is provided a driver 22 integrally therewith. When a trigger 1 is actuated, a cylinder valve 3, which seals the upper end of the cylinder 5, is opened and thus the compressed air of the pressure storage chamber 2 pushes down the piston 4, whereby a fastening member 28 fed into the shooting opening 24 of a nose portion 23 is driven by the leading end of the driver 22.

Also, between the nose portion 23 and a magazine (not shown), there is interposed fastening member feed means 25; and, a plurality of fastening members 28 stored in the magazine can be fed out one by one into the shooting opening 24 of the nose portion 23 by the fastening member feed means 25.

The fastening member feed means 25 is composed of a fastening member feed cylinder 12 and a fastening member feed piston 11. The fastening member feed piston 11 is fitted into the fastening member feed cylinder 12 in such a manner that it can be slid back and forth within the fastening member feed cylinder 12. Also, on the leading end of the fastening member feed piston 11, there is mounted a feed pawl 14 in such a manner that it can be rotated. When the fastening member feed cylinder 12 is operated to thereby reciprocate the feed pawl 14 together with the feed piston 11 along a feed passage 29, the feed pawl 14, in the backward movement thereof, comes in contact with the shaft of the fastening member 28 within the feed passage 29 and is thereby rotated in such a manner to retreat from the feed passage 29, so that it moves beyond the fastening member 28; and, when the feed pawl 14 moves forward, it advances into the feed passage 29 and is engaged with the shaft of the fastening member 28 to thereby feed the fastening member 28.

Here, description will be given below of the subject matter of the invention with reference to FIGS. 1~3.

Figure 1:
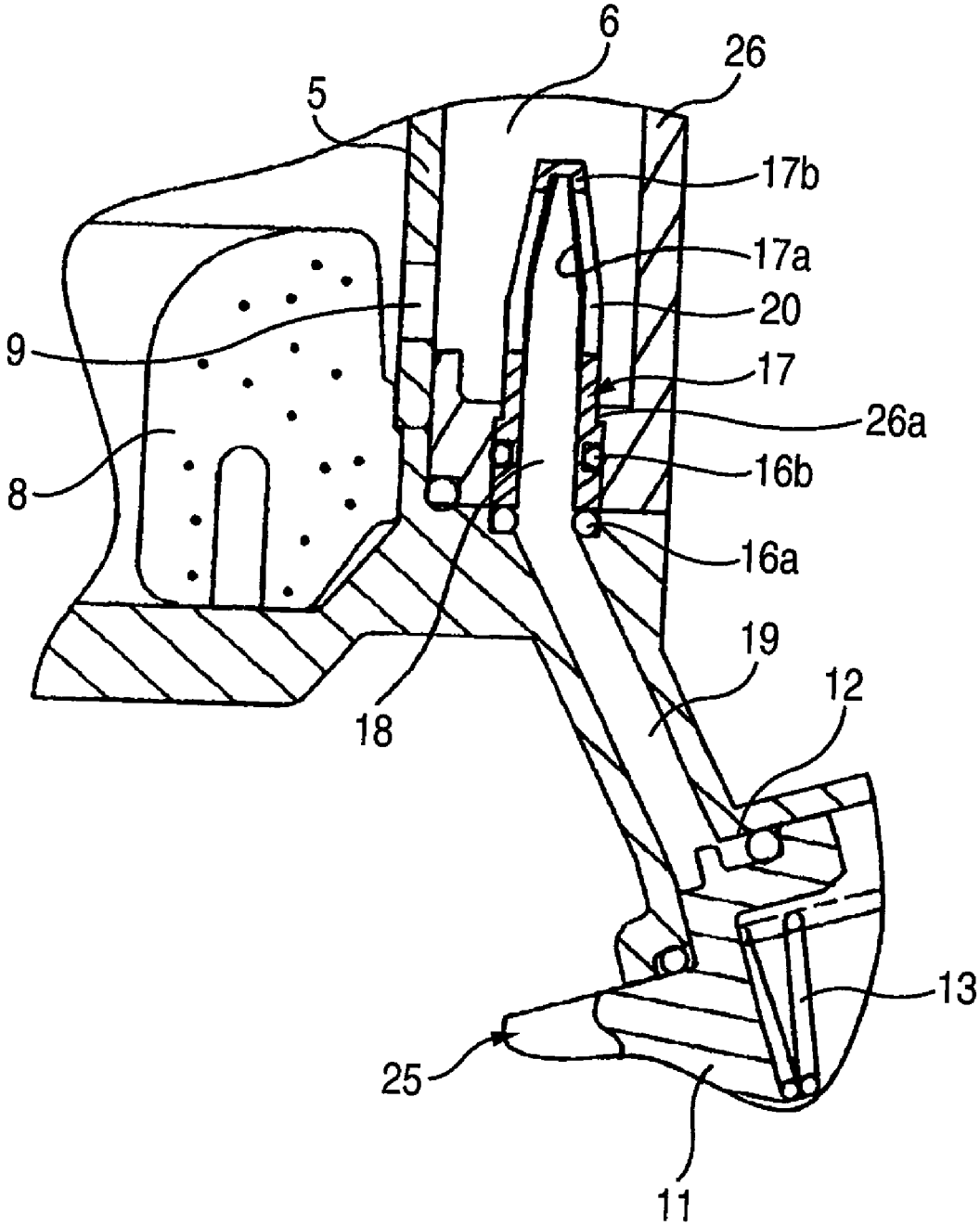
FIG. 1 is a section view of the main portions of a driving machine according to an embodiment of the invention.
Figure 2:
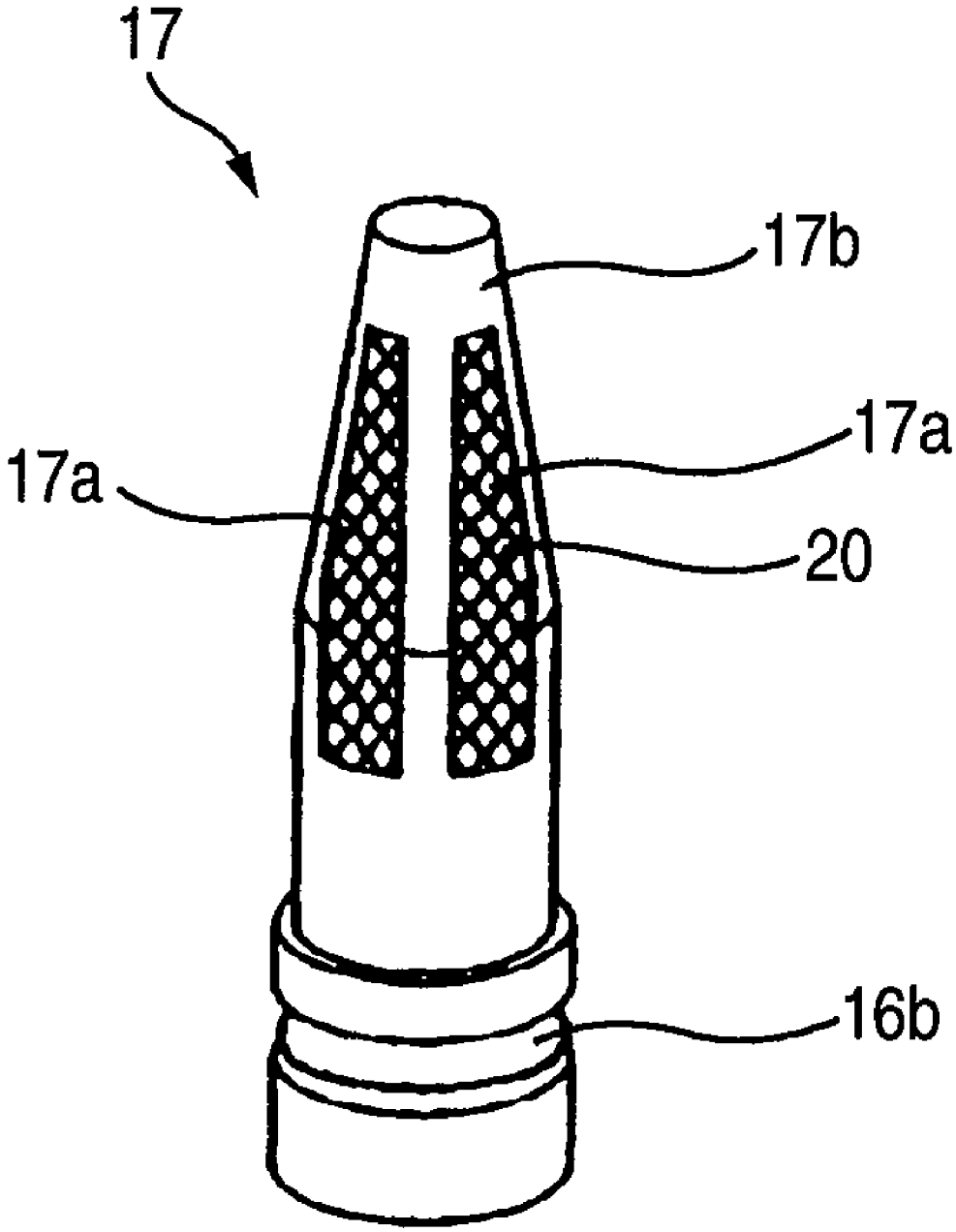
FIG. 2 is a perspective view of the driving machine according to an embodiment of the invention.
Figure 3:
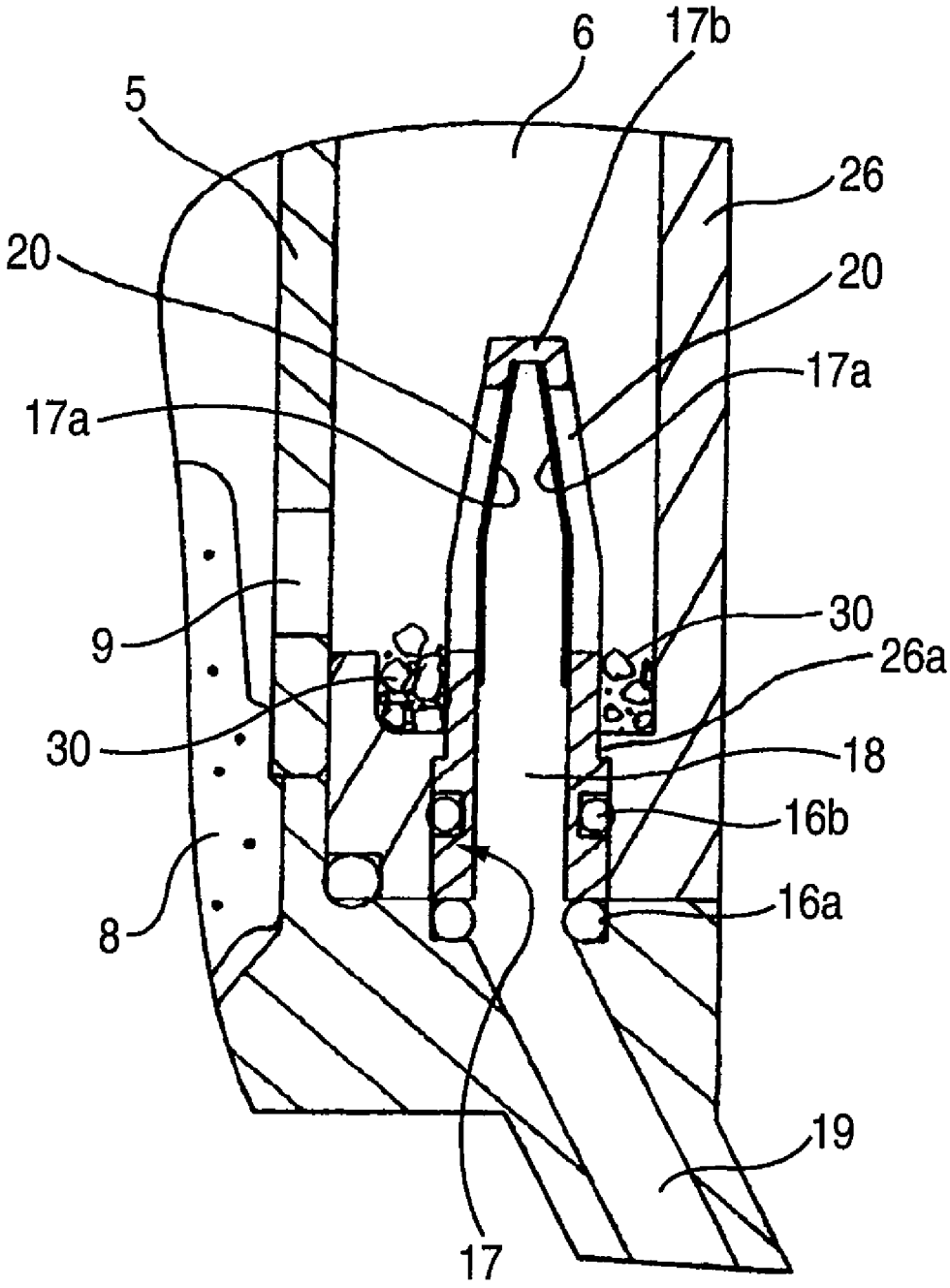
FIG. 3 is an enlarged section view of a filter portion of the driving machine according to an embodiment of the invention.

FIG. 1 is a section view of the main portions of the driving machine according to the invention, FIG. 2 is a perspective view of a filter portion formed in the driving machine, and FIG. 3 is an enlarged section view of the filter portion of the present driving machine.

As shown in FIG. 1, between the air passage 19 and return air chamber 6, there is formed a main body side passage 18 which is used to allow the communication of the compressed air; and, in the main body side passage 18, there is formed a filter portion 17 which includes a plurality of small holes 20. This filter portion 17 is formed in such a manner that its projection-shaped portion 17*b* projects within the return air chamber 6 of a housing 26 in the form of a chimney; and, in the vicinity of the upper portion of the projection-shaped portion 17*b*, there are opened up the plurality of small holes 20 which are used to allow the air passage 19 to communicate with the filter portion 17 from the main body side passage 18.

The filter portion 17 is made of resin such as plastic, while the small holes 20 opened up in the outer periphery of the upper portion of the filter portion 17 are formed of a thin-film-shaped mesh 17*a*. This mesh 17*a* is welded to the filter portion 17 from the inside thereof to thereby form the filter portion 17 as an integral body. Between the filter portion 17 and air passage 19, there are interposed two or more pieces of packing 16*a*, 16*b* which are used to prevent the compressed air from leaking to the air. The filter portion 17 is mounted in such a manner that it penetrates from the outside of the housing 26 and into the return air chamber 6, the small holes 20 of the filter portion 17 are opened in the return air chamber 6, and the filter portion 17 can be separated from the housing 26.

By the way, the housing 26 includes a stepped portion 26*a* which is used to prevent the filter portion 17 from moving into the inside of the housing 26 when the filter portion 17 is mounted from the nose portion 23 side of the housing 26. Also, even when the filter portion 17 is inserted from the return air chamber 6 side of the housing 26, in order to prevent the filter portion 17 from being removed due to pressure, there is additionally provided a structure for prevention of removal of the filter portion 17, for example, a structure for holding the filter portion 17 using a cylinder.

Now, description will be given below of the operation of the above-structured driving machine according to the invention.

In the driving machine according to the invention, when the trigger 1 is pulled, the cylinder valve 3 on the upper end of the cylinder 5 is opened, the compressed air of the pressure storage chamber 2 pushes down the piston 4 suddenly, and the fastening member within the shooting opening 24 is driven by the leading end of the driver 22.

After the above driving operation, the piston 4 collides with the bumper 8 at the lower-most point thereof, and the remaining surplus energy of the piston 4 is absorbed by the bumper 8, whereby the piston 4 is caused to stop. When the piston 4 passes through the air hole 5*a*, a portion of the compressed air is supplied through the air hole 5*a* and a check valve 50 to the return air chamber 6. Further, a portion of the compressed air supplied to the return air chamber 6 is stored from the return air chamber 6 through the air passage 19 into the fastening member feed cylinder 12; and, this compressed air pushes down the fastening member feed piston 11 sliding within the fastening member feed cylinder 12 to thereby retreat the feed pawl 14 from the shooting opening 24.

Next, when the trigger 1 is released, the piston 4 is moved backward. Specifically, the piston 4 is pushed up to the top dead center thereof by the pressure of the return air chamber 6, whereby the compressed air existing in the lower chamber of the piston 4 and in the return air chamber 6 is discharged from either a lower exhaust port 21 through a clearance between the leading end of the driver 22 and the piston 4, or an upper exhaust port 27 through a clearance formed upwardly of the cylinder 5. Also, simultaneously with this, the air existing within the fastening member feed cylinder 12 is also discharged therefrom. Thus, owing to the force of a return spring 13 which is provided on the back surface of the driving machine, the fastening feed piston 11 and feed pawl 14 existing within the fastening member feed cylinder 12 are returned within the feed passage 29 to feed the fastening member 28 again into the shooting opening 24, thereby ending 1 driving cycle.

When the above-mentioned driving cycle is repeated tens of thousands times, the upper surface of the bumper 8 to absorb the surplus energy is gradually caused to crack, resulting in the formation of such broken pieces 30 as shown in FIG. 3. These broken pieces 30 are carried from the return chamber hole 9 into the return air chamber 6 by the force of the compressed air and are going to move from the main body side passage 18 into the air passage 19 which communicates with the fastening member feed cylinder 12. However, since, between the air passage 19 and the main body side passage 18 that communicates with the return chamber 6 on the main body 7 side, there is interposed the filter portion 17 including a large number of small holes 20 which are made of the mesh 17*a* and are situated in the vicinity of the leading end of the projection-shaped portion 17*b*, not only small-size broken pieces 30 but also large-size broken pieces 30 can be prevented from moving into the air passage 19.

Also, even when the broken pieces 30 happen to move into the main body side passage 18 and stick to and cover the small holes 22 of the mesh 17*a* in the leading end of the projection-shaped portion 17*b* of the filter portion 17 entirely, since the projection-shaped portion 17*b* of the filter portion 17 projects in a chimney shape, the broken pieces 30 can be easily diffused due to the force of the compressed air discharged or the broken pieces 30 are easy to slip down in the downward direction within the return air chamber 6 due to the own mass of the broken pieces and are thus easy to accumulate in the lower portion of the return air chamber 6, thereby eliminating a possibility that the whole of the small holes 20 can be covered completely by the broken pieces 30. This makes it possible for the filter portion 17 to sufficiently secure an effective section area equal to the passage area. Also, when the filter portion 17 is formed separately from the housing 26, the filter portion 17 can be taken out from the housing 26 easily, so that the broken pieces 30 sticking to neighboring portion of the upper portion of the filter portion 17 can be cleaned easily.

Figure 4:
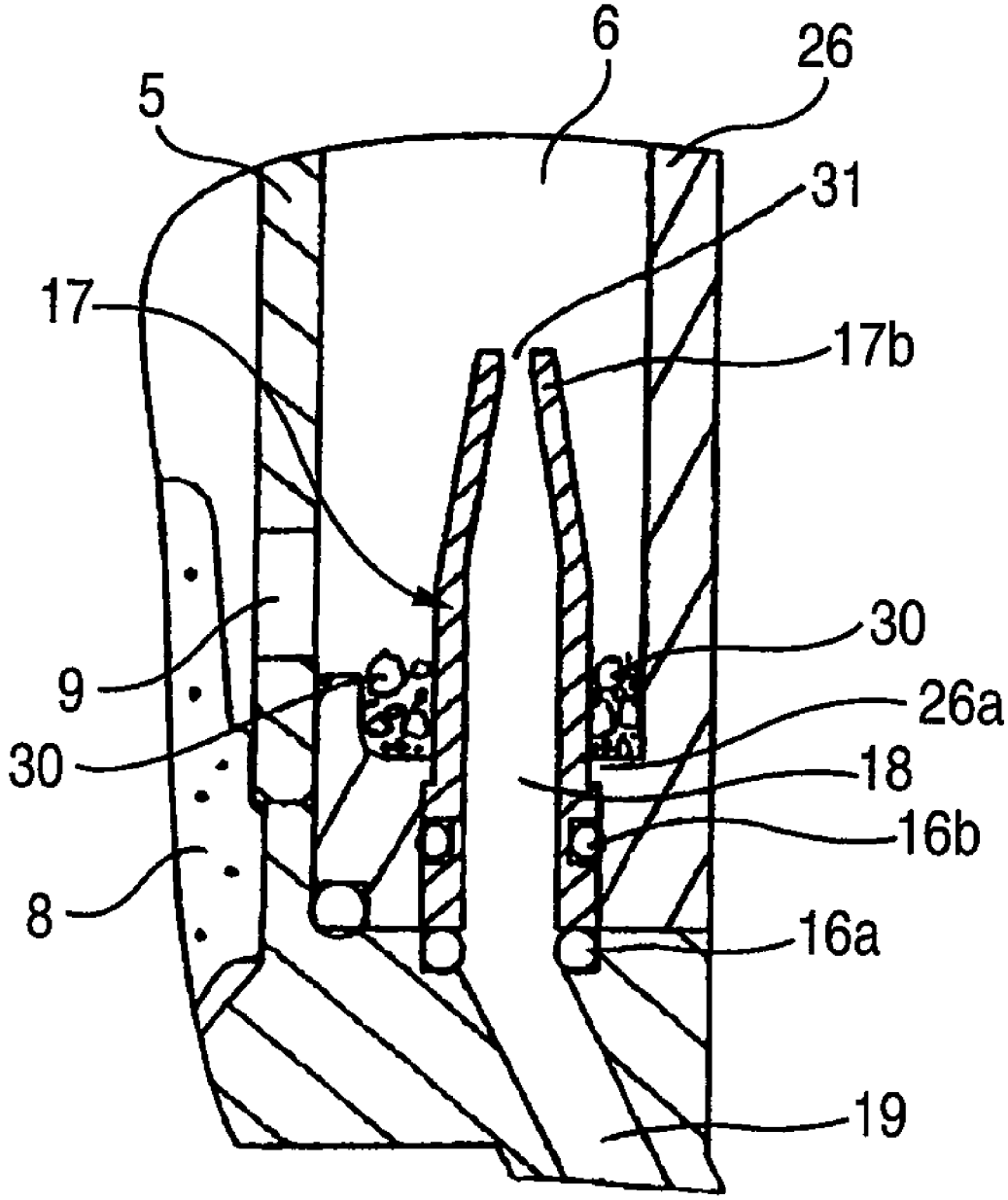
FIG. 4 is an enlarged section view of a filter portion of a driving machine according to another embodiment of the invention.
Figure 5:
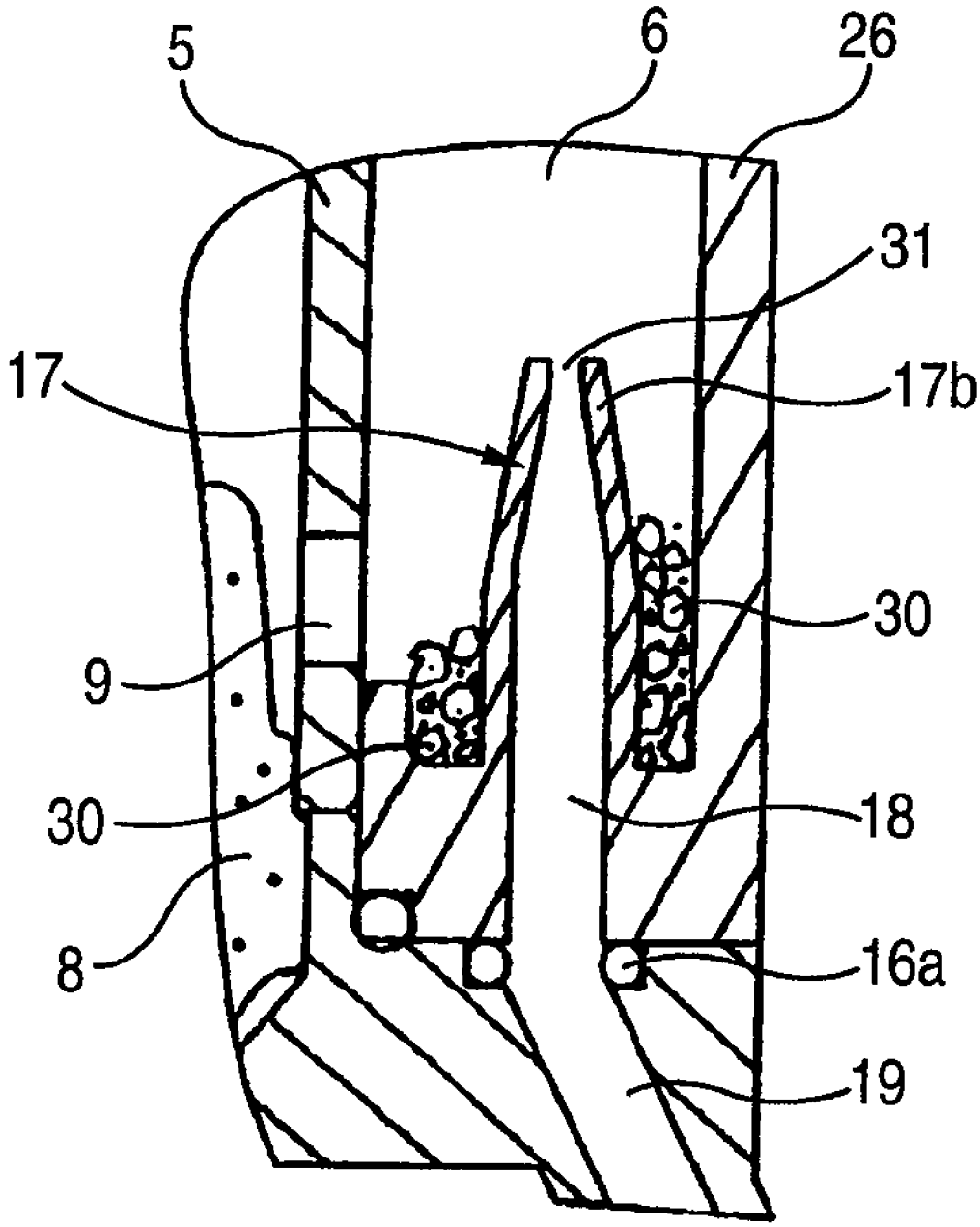
FIG. 5 is an enlarged section view of a filter portion of the driving machine according to another embodiment of the invention.

In the above-described embodiment, there is employed a structure in which the filter portion 17 including the small holes 20 is disposed within the air passage 19 to the fastening member feed piston 11 on the return air chamber 6 side of the housing 26, and the mesh 17*a* is welded to the filter portion 17 to thereby provide an integral body. However, as shown in FIGS. 4 and 5, even in another structure in which the filter portion 17 has a chimney-like projection shape similar to the above-mentioned embodiment, small holes 31 are formed in the vicinity of the upper portion of the leading end of the projection-shaped portion 17*b*, and the filter portion 17 is formed removably from the housing 26 or integrally with the housing 26, the broken pieces 30 of the cracked bumper 8 are easy to accumulate on the lower portion of the housing 26. Therefore, in this structure as well, there can be obtained effects similar to the above-mentioned structure.

What is claimed is:

1. A driving machine using compressed air as a power source, comprising:

a cylinder;

a piston fitted into the cylinder such that it can be reciprocated;

a driver connected to the piston;

a bumper provided on the bottom portion of the cylinder;

a housing disposed to cover the cylinder from outside and including therein a pressure storage chamber for storing compressed air;

a return air chamber formed in the outer periphery of the cylinder for storing the return compressed air that is used to move up and return the piston;

an exhaust port, after the piston is returned, for discharging compressed air existing downwardly of the piston to the air;

a fastening member feed piston movable backward or movable forward by supplying the compressed air of the return air chamber from the passage hole of the return air chamber through an air passage into the fastening member feed cylinder or by discharging such compressed air from the fastening member feed cylinder;

a return spring for energizing the fastening member feed piston in one direction; and a feed pawl mounted on the leading end of the fastening member feed piston, wherein, within the air passage formed between the return air chamber and the fastening member feed cylinder, there is formed a filter portion, and in the vicinity of the leading end of the projection-shaped portion of the filter portion, there is formed the passage hole.

2. A driving machine as set forth in claim 1, wherein the passage hole opened up in the vicinity of the leading end of the projection-shaped portion of the filter portion is made of a thin-film-shaped mesh, and the passage hole is opened in the return air chamber by mounting the mesh from the outside of the housing into the return air chamber.

3. A driving machine as set forth in claim 2, wherein the filter portion is made of plastic, and the filter portion and the mesh are formed as an integral body.

4. A driving machine as set forth in claim 1, wherein since there can be secured a large opening area in the filter portion, the filter portion can be sufficiently secured to provide a flow-in area equal to or larger than the air passage.

5. A driving machine as set forth in claim 1, wherein the filter portion includes a plurality of small holes.

6. A driving machine as set forth in claim 1, wherein the filter portion is formed in such a manner that its projection-shaped portion projects within the return air chamber of a housing in the form of a chimney, and wherein in the vicinity of an upper portion of the projection-shaped portion there are opened up a plurality of small holes which are used to allow an air passage to communicate with the filter portion from a main body side passage.

7. A driving machine as set forth in claim 1, wherein the filter portion is made of resin such as plastic, while small holes in an outer periphery of an upper portion of the filter portion are formed of a thin-film-shaped mesh.

8. A driving machine as set forth in claim 7, wherein the mesh is welded to the filter portion from the inside thereof to thereby form the filter portion 17 as an integral body.

9. A driving machine as set forth in claim 1, wherein between the filter portion and an air passage which communicates to the return air chamber, there are interposed two or more pieces of packing which are used to prevent the compressed air from leaking to the air.

10. A driving machine as set forth in claim 1, wherein the filter portion is mounted in such a manner that the filter portion penetrates from outside of the housing and into the return air chamber and the filter portion can be separated from the housing.

11. A driving machine using compressed air as a power source, comprising:

a cylinder;

a piston fitted into the cylinder such that it can be reciprocated;

a driver connected to the piston;

a bumper provided on the bottom portion of the cylinder;

a housing disposed to cover the cylinder from outside and including therein a pressure storage chamber for storing compressed air which is supplied to an upper portion of the cylinder to move down the piston;

a return air chamber formed in the outer periphery of the cylinder for storing return compressed air that is used to move up and return the piston; and an exhaust port, after the piston is returned, for discharging compressed air existing downwardly of the piston to the air, wherein said driver drives a fastening member into a workpiece when the piston is moved down, and wherein, within an air passage, formed between the return air chamber and a fastening member feed cylinder which uses the compressed air to feed fastening members to be driven into the workpiece, there is formed a projection-shaped filter portion having a leading end within which is formed a passage hole.

12. A driving machine as set forth in claim 11, wherein the passage hole is made of a thin-film-shaped mesh, and the passage hole is opened in the return air chamber by mounting the mesh from the outside of the housing into the return air chamber.

13. A driving machine as set forth in claim 12, wherein the filter portion is made of plastic, and the filter portion and the mesh are formed as an integral body.

14. A driving machine as set forth in claim 11, wherein since there can be secured a large opening area in the filter portion, the filter portion can be sufficiently secured to provide a flow-in area equal to or larger than the air passage.

15. A driving machine as set forth in claim 11, wherein the filter portion includes a plurality of small holes.

16. A driving machine as set forth in claim 11, wherein the filter portion is formed in such a manner that its projection-shaped portion projects within the return air chamber of a housing in the form of a chimney, and wherein in the vicinity of an upper portion of the projection-shaped portion there are opened up a plurality of small holes which are used to allow an air passage to communicate with the filter portion from a main body side passage.

17. A driving machine as set forth in claim 11, wherein the filter portion is made of resin such as plastic, while small holes in an outer periphery of an upper portion of the filter portion are formed of a thin-film-shaped mesh.

18. A driving machine as set forth in claim 17, wherein the mesh is welded to the filter portion from the inside thereof to thereby form the filter portion 17 as an integral body.

19. A driving machine as set forth in claim 11, wherein between the filter portion and an air passage which communicates to the return air chamber, there are interposed two or more pieces of packing which are used to prevent the compressed air from leaking to the air.

20. A driving machine as set forth in claim 11, wherein the filter portion is mounted in such a manner that the filter portion penetrates from outside of the housing and into the return air chamber and the filter portion can be separated from the housing.

* * * * *